US009909465B2

(12) United States Patent
Bender et al.

(10) Patent No.: US 9,909,465 B2
(45) Date of Patent: Mar. 6, 2018

(54) CAMSHAFT ADJUSTING DEVICE, COMBUSTION ENGINE AND ASSEMBLY METHOD

(71) Applicant: ETO Magnetic GmbH, Stockach (DE)

(72) Inventors: Stefan Bender, Engen (DE); Harald Eckhardt, Uhldingen-Muehlhofen (DE); Peter Vincon, Stockach (DE)

(73) Assignee: ETO Magnetic GmbH, Stockach (DE)

( * ) Notice: Subject to any disclaimer, the term of this patent is extended or adjusted under 35 U.S.C. 154(b) by 64 days.

(21) Appl. No.: 15/106,455

(22) PCT Filed: Nov. 12, 2014

(86) PCT No.: PCT/EP2014/074404
§ 371 (c)(1),
(2) Date: Jun. 20, 2016

(87) PCT Pub. No.: WO2015/090741
PCT Pub. Date: Jun. 25, 2015

(65) Prior Publication Data

US 2017/0002700 A1 Jan. 5, 2017

(30) Foreign Application Priority Data

Dec. 20, 2013 (DE) ..... 10 2013 114 625

(51) Int. Cl.
*F01L 1/46* (2006.01)
*F01L 1/344* (2006.01)
*F01L 13/00* (2006.01)

(52) U.S. Cl.
CPC ..... *F01L 1/3442* (2013.01); *F01L 1/344* (2013.01); *F01L 1/46* (2013.01);
(Continued)

(58) Field of Classification Search
CPC ..... F01L 1/3442; F01L 2001/3443; F01L 2001/34479; F01L 1/46; F01L 2013/101; F01L 2820/031
(Continued)

(56) References Cited

U.S. PATENT DOCUMENTS 7,011,059 B2 3/2006 Plank et al.
8,941,454 B2 1/2015 Grunschlag et al.
(Continued)

FOREIGN PATENT DOCUMENTS

DE 102 11 467 9/2003
DE 102006031517 1/2008
(Continued)

OTHER PUBLICATIONS

German Office action for Patent Application No. 10 2013 114 625.2 dated Aug. 7, 2014.
International search report for Patent Application No. PCT/EP2014/074404 dated Feb. 19, 2015.

*Primary Examiner* — Jorge Leon, Jr.
(74) *Attorney, Agent, or Firm* — Bachman & LaPointe, PC

(57) ABSTRACT

A camshaft adjustment device comprising an electromagnetic actuator (3) having an armature that can be adjusted axially along an adjustment axis (5) for actuating a hydraulic valve for camshaft adjustment, and fastening means for fastening the actuator (3) on an engine element (3), wherein the fastening means comprise spring means (12), which tension the actuator (3) against the engine element (2) in a securing position (13), wherein the fastening means have positive-fitting means (8) as an anti-twist device for preventing a twisting movement of the actuator (3) in an installation position (7) relatively to the engine element (2), which are constructed and arranged in such a manner that the actuator (3) can be moved to the engine element (2) by
(Continued)

means of a pure translational installation movement and wherein the spring means (12) in the securing position (13) bar a de-installation path for a purely translational de-installation movement of the actuator (3) opposite to the installation movement in such a manner that the same cannot be de-installed oppositely to the purely translational installation direction.

16 Claims, 18 Drawing Sheets

(52) U.S. Cl.
CPC ..... *F01L 2001/3443* (2013.01); *F01L 2001/34433* (2013.01); *F01L 2001/34483* (2013.01); *F01L 2013/101* (2013.01); *F01L 2820/031* (2013.01)

(58) Field of Classification Search
USPC ..... 123/90.17
See application file for complete search history.

(56) References Cited

U.S. PATENT DOCUMENTS

| | | | | |
|---|---|---|---|---|
| 8,991,343 | B2 | 3/2015 | Hoppe et al. | |
| 2005/0056245 | A1 | 3/2005 | Plank et al. | |
| 2012/0312262 | A1* | 12/2012 | Hoppe | F01L 1/3442 123/90.17 |
| 2013/0234816 | A1* | 9/2013 | Grunschlag | H01F 7/126 335/278 |

FOREIGN PATENT DOCUMENTS

| | | |
|---|---|---|
| DE | 102007019923 | 10/2008 |
| DE | 102008051145 | 4/2010 |
| DE | 102009020652 | 11/2010 |
| DE | 102010012917 | 4/2011 |
| DE | 102010008931 | 8/2011 |
| DE | 202010007406 | 11/2011 |
| DE | 102010047414 | 4/2012 |
| DE | 202011050746 | 12/2012 |
| DE | 102012003648 | 3/2013 |

* cited by examiner

CAMSHAFT ADJUSTING DEVICE, COMBUSTION ENGINE AND ASSEMBLY METHOD

BACKGROUND OF THE INVENTION

The invention relates to a camshaft adjustment device comprising an electromagnetic actuator with an armature for actuating a hydraulic valve for camshaft adjustment, which armature can be adjusted axially along an adjustment axis. The camshaft adjustment device comprises fastening means for fastening the actuator on an engine element, particularly a housing element, for example a chain box or on the engine block. Furthermore, the invention relates to an internal combustion engine, particularly a motor vehicle internal combustion engine having one such camshaft adjustment device and an assembly method for a camshaft adjustment device. Camshaft adjustment devices for internal combustion engines have been known for a long time and are used for changing the relative angular position of the camshaft and therefore the camshaft with respect to the crankshaft of an internal combustion engine. The camshaft adjustment in this case takes place hydraulically, wherein the control of the pressure fluid takes place by means of a hydraulic valve, which can be actuated by means of an actuator comprising an armature that can be adjusted axially along an adjustment axis.

To fasten the actuator of the camshaft adjustment device on an engine element, it is known to use a screw connection, as is disclosed for example in DE 102 11 467 A1, DE 10 2007 019 923 A1 and DE 10 2006 031 517 A1. This installation is relatively complex and therefore comparatively expensive.

Therefore, camshaft adjustment devices that are simpler to install were developed by the applicant, as are described for example in DE 20 2010 007 406 U1. In the camshaft adjustment device presented there, the fastening means comprise a plurality of resilient elements arranged in a distributed manner over the circumference to form a plug-and-twist connection, in order to thus be able to install the actuator on an engine element in a simplified manner by means of a twisting movement.

A camshaft adjustment device is known from DE 10 2012 003 648 B3, in which the actuator is likewise fastened on an engine element in a plug-and-twist movement. It is disadvantageous in the known solution however that sufficient space must be kept free in the circumferential direction for realising the twisting movement for transferring the actuator to its installation position, which space cannot be used for arranging further functional parts. Furthermore, it is disadvantageous that the actuator of the known camshaft adjustment device can still be displaced out of its instillation position inadvertently by applying a sufficiently large de-installation force in the circumferential direction.

A stator unit for an electromagnetic camshaft adjustment device is known from DE 20 2011 050 746 U1, in which the electromagnetic actuator can be installed and de-installed in a combined plug-and-twist movement. In an installation position, it is possible to twist the electromagnetic actuator.

A camshaft adjustment device is known from DE 10 2010 012 917 A1, which can be installed and de-installed merely in a combined plug-and-twist movement, wherein it is possible to twist the actuator in an installation position. In one embodiment, the actuator is secured by means of a spring clip.

It is problematic for all camshaft adjustment devices in which the actuator is fastened on the engine element by means of a plug-and-twist movement that a sealing ring that is used and generally seals in the radial direction is loaded with force axially and in the circumferential direction (rotational movement) during installation, as a result of which the sealing ring is exposed to extreme forces, which can lead to premature damage of the sealing ring.

Furthermore, manual installation is inconvenient due to the high required forces.

A further problem exists in that known twist-and-plug connections are made more difficult due to the required loading of the sealing ring in the axial direction (excess pressures) and in the circumferential direction (rotational movement), as a result of which conventional o-rings cannot be used, rather special seals are used, using which an attempt it made to alleviate the above problems.

SUMMARY OF THE INVENTION

Starting from the previously mentioned prior art, the invention is therefore based on the object of specifying a camshaft adjustment device having an actuator which can be installed using a simple, preferably minimally force intensive installation movement and is better secured against inadvertent de-installation. Furthermore, the object consists in specifying an internal combustion engine having such a camshaft adjustment device and a simplified installation method for a camshaft adjustment device, which guarantees optimal securing of the actuator on the engine element.

This object is achieved with the features disclosed herein with regards to the camshaft adjustment device, with the features disclosed herein with regards to the internal combustion engine and also with the features disclosed herein with regards to the installation method. Advantageous developments of the invention are specified in the subclaims. All combinations of at least two features disclosed in the description, the claims and/or the figures fall within the scope of the invention. To avoid repetitions, features disclosed according to the device should be considered disclosed and claimable according to the method. Likewise, features disclosed according to the method should be considered disclosed and can be claimed according to the device.

The invention is based on the idea of constructing the fastening means of the camshaft adjustment device in such a manner that the actuator can be transitioned in a pure translational movement, particularly a pure plugging movement, preferably along the longitudinal extent of the adjustment axis of the axially adjustable armature of the actuator, into its installation position on the engine element, in which the actuator is secured against twisting in the circumferential direction relatively to the engine element, wherein in reverse, the de-installation movement can likewise be executed purely translationally in a direction opposite to the installation direction. Installation space can be saved in the circumferential direction in this manner, as no space needs to be kept free on the engine element for realising a twisting movement of the actuator, particularly on account of a radially protruding contact socket (connection socket) of the actuator, which may be provided. It is provided as a further inventive measure that the spring means, with which the actuator can be tensioned against the engine element in a securing position in which they display the previously mentioned tensioning action and block the de-installation path 180° opposite to the installation path, preferably along the adjustment axis of the armature, i.e. along the longitudinal extent of the adjustment axis of the armature, for example in that they engage into the actuator or grip or penetrate the same. In this case, by contrast with embodiments from the prior art, the spring means load the actuator with a spring force in the (translational) installation direction. The spring means are therefore assigned a double function in their securing position—they apply a spring force in the installation direction onto the actuator in the direction of the engine element and furthermore block a translational de-installation path, wherein, at the same time, twisting of the actuator in its installation position in the circumferential direction is reliably prevented by means of the positive-fitting means, into which the actuator can exclusively be inserted translationally.

The installation method according to the invention picks up the previous constructive design, in that the actuator is transitioned into its installation position on the engine element in a pure translational installation movement (plugging movement), preferably in the direction of the adjustment axis of the armature, particularly preferably in the direction of the longitudinal extent (adjustment direction) of a valve tappet of the camshaft adjustment valve, which tappet can be actuated by means of the armature, in which installation position the actuator is secured against twisting in the circumferential direction by means of the positive-fitting means, wherein the spring means are transitioned into a securing position after the transition of the actuator into its installation position, particularly by adjusting the spring means in a plane extending perpendicularly to the installation direction, wherein the spring means in this securing position on the one hand apply an axial tensioning force onto the actuator in the direction of the engine element and furthermore bar or block a de-installation movement opposite to the installation movement or a de-installation path opposite to the installation path, particularly in that the spring means penetrate or grip the actuator or at least engage into the same, in any case start to interact with the same in such a manner that the same cannot be translationally de-installed oppositely to the translational installation direction. Preferably, the spring means are the sole means which prevent the translational, particularly destruction-free, de-installation, i.e. according to a preferred embodiment, no further elements are located in the de-installation path.

The embodiment according to the invention of the camshaft adjustment device and the realisation according to the invention of the installation method and of the de-installation method ensure that a sealing ring preferably provided on the actuator, which in the installed state particularly preferably seals the actuator with respect the engine element in the radial and/or axial direction, is not loaded with force in the circumferential direction in the absence of a rotational movement during installation, as a result of which the sealing ring is optimally protected. This can be traced back to the separation according to the invention of the installation steps of plugging the actuator and therefore excess pressure on the radial sealing o-ring and the installation force for the spring clips which is orientated at an angle thereto.

Furthermore, the installation force and the de-installation force are reduced considerably compared to the prior art, particularly for manual installation purposes. Also, there is the option to use conventional o-ring seals as sealing ring—it is possible to dispense with special geometries to minimise the pressure. Particularly preferably, the o-ring seal is moved axially along a lead-in chamfer during installation, which ensures that the sealing ring, which is preferably realised as an o-ring seal, is loaded with a radial-force component owing to the axial movement and therefore the sealing ring is compressed in the radial direction. As a result, when moved along the lead-in chamfer, the o-ring seal is loaded with force exclusively in the axial direction and in the radial direction, but not in the circumferential direction.

In a development of the invention, it is advantageously provided that the actuator is axially guided, particularly by means of the positive-fitting means, during its translational installation movement, particularly during an end section of this installation movement, i.e. is secured against twisting in the circumferential direction. This can be realised in that the positive fitting means of actuator and engine element axially engage into one another already before the installation position of the actuator on the engine element is reached.

There are different possibilities with regards to the actual design of the positive-fitting means. It is important that, by means of an axial engagement into one another, particularly along the armature adjustment axis, the same prevent a, preferably any, twisting movement of the actuator in its installation position. In this case, it is for example possible to provide at least one positive-fitting element extending parallel to the adjustment axis on the actuator, which positive-fitting element is accommodated in the installation position (and preferably even a little before that) in each case between two counterpart elements that are spaced around the adjustment axis of the armature in a circumferential direction and extend parallel to the adjustment axis. Instead of counterpart elements that are spaced in the circumferential direction, two counterpart-element sections that are spaced in the circumferential direction, for example two internal circumference sections of an accommodation opening in the engine element may also be provided. Additionally or alternatively, the preceding arrangement can also be realised in reverse, namely in that in the installation position (and preferably even a little before that) at least one positive-fitting element provided on the engine element and extending parallel to the adjustment axis of the armature in the direction of the actuator is accommodated in each case between two counterpart elements or counterpart element sections that are spaced around the adjustment axis in a circumferential direction and extend parallel to the adjustment axis, for example internal circumference sections of an opening in the actuator. Independently of whether the counterpart elements or counterpart element sections are provided on the actuator or on the engine element, they delimit a translationally accessible installation opening, into which the opposite positive-fitting element can be introduced, and thereby transitioned into the installation position, by means of a translational adjustment movement of the actuator onto the engine element.

Preferably, the positive-fitting element and/or the counterpart elements of the actuator extend(s) radially outwards in the radial direction.

To bar a translational de-installation path that is opposite to the translational installation path, it is preferred if the spring means in their securing position penetrate the positive-fitting means, particularly the positive-fitting element and/or the counterpart elements or counterpart element sections, or at least engage into an accommodation opening of the positive-fitting element or at least a counterpart element or counterpart element section. The positive-fitting element can thereby be fixed in its securing position at the same time. It has proven particularly advantageous in this case if the spring element is accommodated between two opposite counterpart elements of the engine element in the circumferential direction and in the process grips the positive-fitting element of the actuator or penetrates the same.

It is also possible that the positive-fitting element is penetrated by the spring means, particularly at an angle to a de-installation direction and is supported axially on the counterpart elements.

It is expedient if the spring means can be transitioned to the securing position in a translational or rotational fixing movement, in which securing position they bar the de-installation path and load the actuator with spring force, wherein it is particularly preferred if the translational or rotational fixing movement can be executed in a fixing plane extending at an angle, very particularly preferably perpendicularly to the adjustment axis of the armature and therefore at an angle or perpendicularly to the installation or de-installation direction. There are different possibilities with regards to the actual design of the spring means.

It is particularly expedient if the spring means comprise an in particular metallic spring strip, which is constructed resiliently perpendicularly to its longitudinal or circumferential extent around the adjustment axis of the actuator, particularly by means of the provision of at least one elastically deformable bend or curvature, which extends perpendicularly to the longitudinal extent of the spring strip. Alternatively to a spring strip, a spring clip can also be used for example, which has two, particularly strip-shaped sections, wherein one of the sections is preferably constructed in a planar manner and the other has a curvature. A clip-like design facilitates the pre-installation of the spring means in a pre-installation position on the actuator. Independently of the actual design of the spring means, for example as at least one spring strip or at least one spring clip, it is preferable to provide a plurality of spring elements, particularly spring strips or spring clips, preferably two spring elements, particularly spring strips or spring clips, and to connect the same to one another via a connecting section, particularly to connect the same in one piece, in order to be able to thus simultaneously move both spring elements to positions which are spaced around the adjustment axis of the armature in the circumferential direction, i.e. to be able to move the spring elements into the securing position by means of a common fixing movement, in which securing position they preferably load the actuator with spring force in the direction of the engine element in each case and simultaneously bar or block the translational de-installation path.

As already stated, it is particularly expedient for a simplified installation if the spring means can be pre-installed into a recess of the actuator in particular and in the installation position of the actuator can be transitioned out of a pre-installation position on the actuator into the securing position. Preferably, the spring means are held in the pre-installation position on the actuator resiliently, particularly by means of latching or exclusively by means of clamping.

There are different possibilities with regards to the actual design of the spring means for making it possible to pre-install, which are preferably constructed as a stamped bent part or parts. One possibility consists in the previously mentioned design of the spring means as a spring clip. However, the capacity to pre-install is also possible in the case of a different, for example in the case of a strip-shaped, design of the spring means, particularly if the spring means—independently of the realisation of a strip shape—comprise two for example parallel spring sections, namely a main spring section, which is responsible for the tensioning of the actuator against the engine element in the securing position, and an auxiliary spring section for the, for example clamping and/or resilient, holding of the spring means in a pre-installation position on the actuator, wherein the auxiliary spring section is preferably constructed and/or arranged in such a manner that in the securing position of the spring means the same does not tension the actuator against the engine element or tensions the actuator against the engine element with a smaller spring force than the main spring section, so that it is prevented that an otherwise provided addition of the spring forces of the spring sections would make the transition of the spring means into the securing position more difficult.

So that the auxiliary spring section in the securing position acts less strongly or does not act on the actuator, it is preferred to displace the spring bends of the main spring section and auxiliary spring section in the direction of the longitudinal extent of main spring section and auxiliary spring section and/to construct the auxiliary spring section more narrowly and/or from a thinner material than the main spring section.

In order to ensure an exact position of the spring means in the securing position or to precisely define the securing position, it is preferred to provide the spring means with a stop, which is constructed in such a manner that it delimits the fixing movement into the securing position. The stop can for example be realised as an angled end of a spring-strip-shaped spring means. It is also possible to provide the spring means with a gripping section, which is preferably arranged at an angle to the longitudinal extent of the spring means, particularly of a spring strip, in order to be able to grip the spring means more easily and therefore install and de-install the same more easily. It is also conceivable that the previously mentioned gripping section is simultaneously used as a stop. Additionally or alternatively to realising a stop on the spring means, it is possible to construct a stop delimiting the installation movement, i.e. fixing movement of the spring means, on the engine element, for example as an axial end of a spring-means guide. One such embodiment is advantageous in particular if a stop on the spring means is dispensed with and/or a gripping section for simpler gripping of the same is provided on the spring means.

In order to secure the spring means in the securing position against an inadvertent movement counter to a fixing direction, it is preferred to realise a positive fit between the spring means and the actuator and/or the engine element, particularly in that an opening or depression is provided in the spring means, which interacts in a positive-fitting manner with an elevation of the actuator or the engine element. The previously explained positive fit can also be realised in order to secure the spring means in the pre-installation position on the actuator in a positive-fitting manner.

BRIEF DESCRIPTION OF THE DRAWINGS

Further advantages, features and details of the invention result from the following description of preferred exemplary embodiments, as well as on the basis of the drawings.

In the figures.

In the figures, the same elements and elements with the same function are labelled with the same reference numbers.

DETAILED DESCRIPTION

Figure 1:
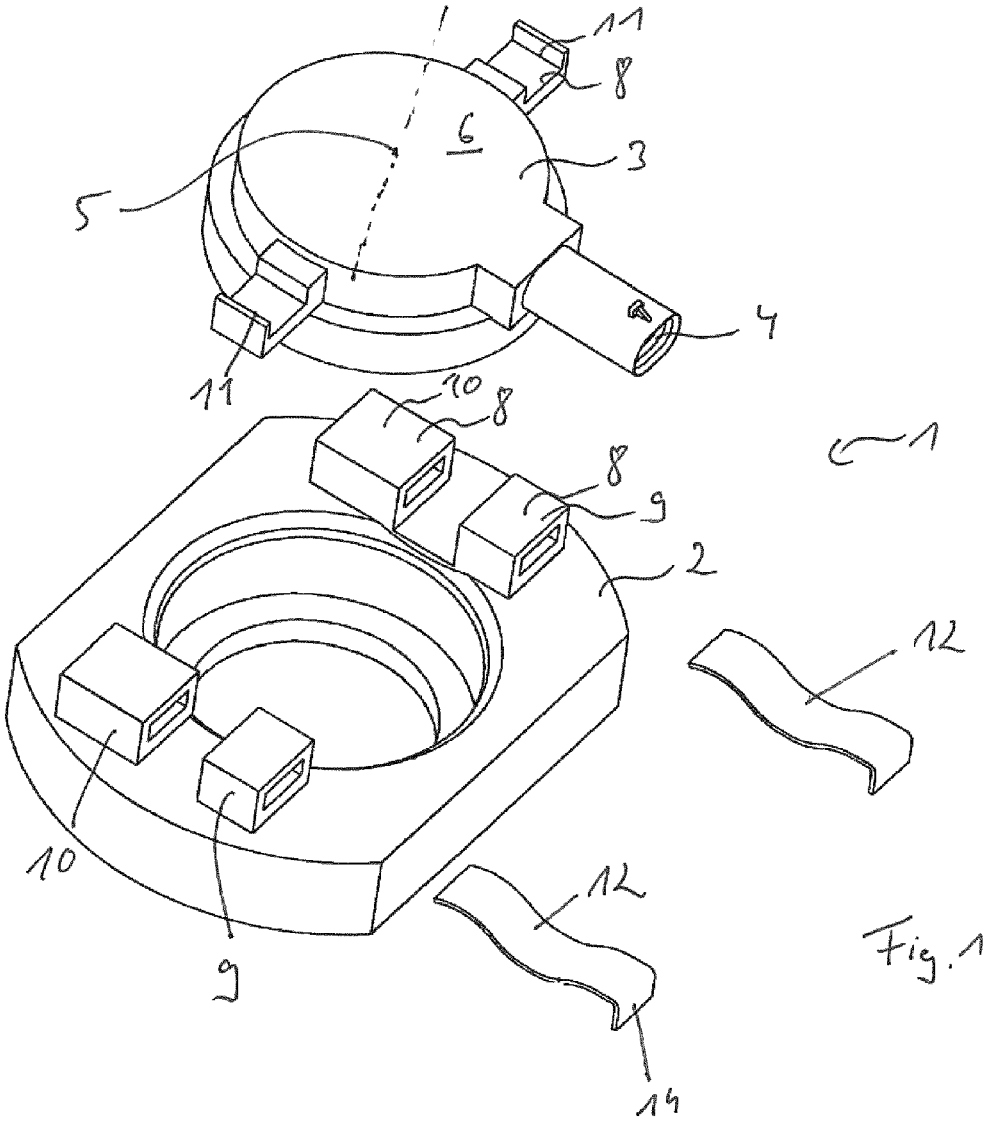
FIGS. 1 to 2: show sections of a first exemplary embodiment of a camshaft adjustment device in different installation or fixing stages, wherein the spring means in their securing position penetrate counterpart elements of the engine element and engage into opposite counterpart elements.
Figure 2:
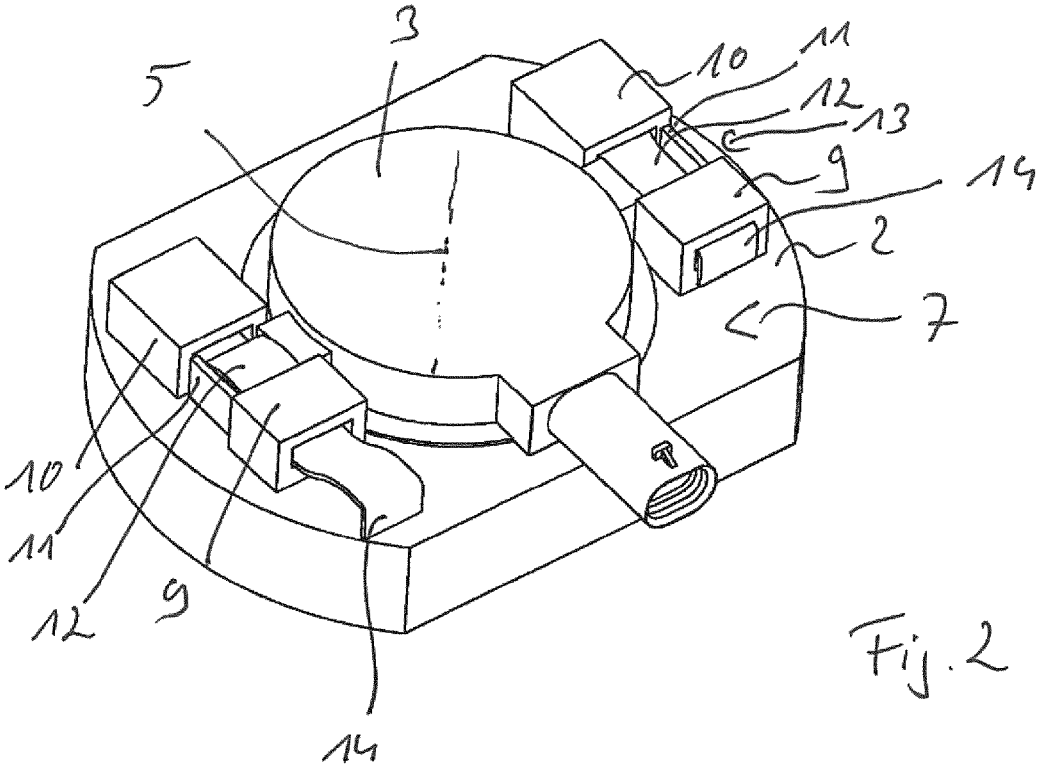

A first exemplary embodiment of a camshaft adjustment device 1 is shown in FIGS. 1 and 2 in an illustration of sections. An engine element 2 can be seen, for example a housing of an engine component or directly an engine housing and an actuator 3, which has a powerable winding in its interior that can be powered by means of a connection socket 4. An armature (not shown) provided inside the actuator 3 can be adjusted along an adjustment axis 5 by powering the winding.

In the exemplary embodiment shown, the adjustment axis 5 extends perpendicularly to the areal extent of an upper side 6 of the actuator 3 and perpendicularly to a longitudinal extent of the connection socket 5.

Reference is made to DE 20 2010 007 406 U1 with regards to a possible design of the inner construction of the actuator. Preferably, a ball is assigned to the armature on the end face, using which the armature can be supported on the rotating hydraulic valve.

As can be seen from an overview of FIGS. 1 and 2, the actuator 3 can be transitioned in a pure translational plugging movement along the adjustment axis 5 of the actuator 3 from the position shown in FIG. 1 into the installation position 7 shown in FIG. 2, in which the actuator 3 is secured against twisting in the circumferential direction 2 with the aid of positive-fitting means 8.

In the exemplary embodiment shown, the positive-fitting means comprise two opposite pairs of counterpart elements 9, 10 spaced around the adjustment axis 5 in the circumferential direction on the engine element and also two diametrically opposite positive-fitting elements 11, wherein each positive-fitting element 11 is accommodated in the installation position shown in FIG. 2 between two counterpart elements 9, 10 of the engine element 2 and thus secured against twisting. The installation movement is not a plug-and-twist movement, but rather a pure plugging movement along the adjustment axis 5 of the actuator 3, observed in the installation position 7.

In the installation position, the actuator 3 is axially tensioned against the engine element 2 with the aid of spring means 12 constructed here by way of example as spring strips.

At the same time, the actuator 3 is blocked, in that a de-installation path, which is directed oppositely to the translational installation path, is barred by the spring means when the same are located in a securing position 13, as shown in FIG. 2 on the basis of the spring means 12 on the right in the drawing plane. In this securing position, the spring means can be displaced inwards, as indicated on the left in the drawing plane according to FIG. 2 on the left. In this case, the spring means 12 penetrate the counterpart elements 9 and protrude into the counterpart elements 10 and grip (or alternatively penetrate for example) the positive-fitting elements 11. The spring means 12 are supported on the same in the axial direction in the securing position.

The strip-shaped spring means 12 in each case comprise a stop 14 for delimiting the fixing movement of the spring means 12. As can be seen from FIG. 2, the previously mentioned fixing movement is realised in a plane extending perpendicularly to the adjustment axis 5 of the armature in the actual exemplary embodiment in the context of a translational plugging movement.

The section of the spring means 12 labelled with the reference number 14, which is arranged at an angle to the longitudinal extent of the strip can have a gripping function additionally or alternatively to the stop function, that is to say be used as gripping surface or gripping section for simplified installation and de-installation. In this case, it is preferred if the stop is constructed on the engine element, in order to delimit the installation movement in a defined manner.

Figure 3:
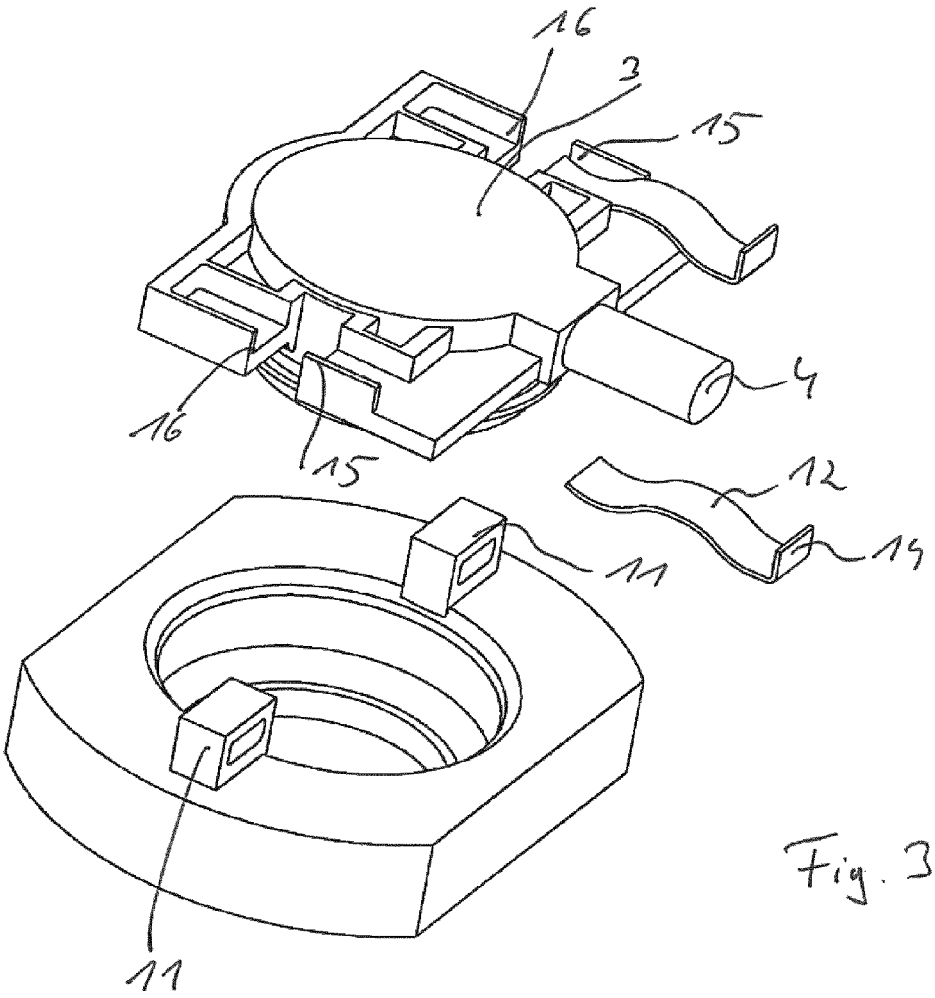
FIGS. 3 and 4: show an alternative exemplary embodiment of a camshaft adjustment device, wherein the spring means penetrate into the securing position of the positive-fitting elements of the actuator.
Figure 4:
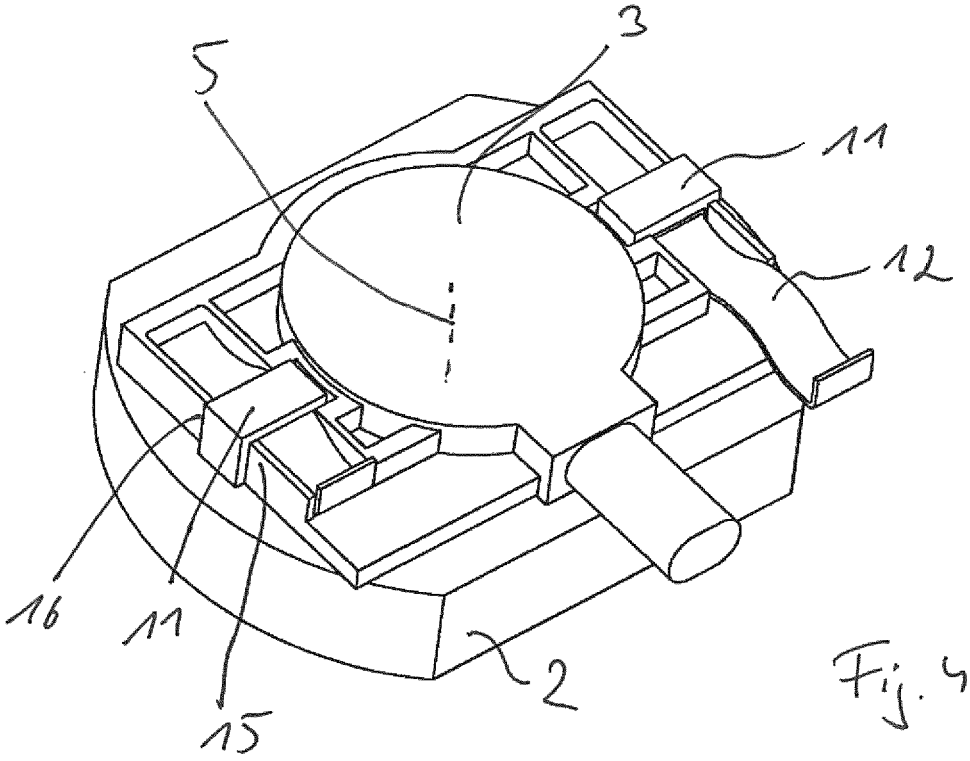

In the exemplary embodiment according to FIGS. 3 and 4, the actuator 3 can likewise be installed in a pure plugging movement, wherein positive-fitting elements 11 are provided on the engine element 2 in the exemplary embodiment according to FIGS. 3 and 4 and are gripped in the installation position by counterpart elements 15, 16 of the actuator 3, in order thus to reliably prevent a rotation of the actuator 3 around the adjustment axis 5 of the armature relatively to the engine element 2 in the installation position.

In the installation position, the spring means 12, which are likewise strip-shaped by way of example here, can be transitioned into a securing position illustrated on the left in the drawing plane in FIG. 4 by means of a purely translational movement in a plane extending perpendicularly to the adjustment axis 5, wherein the spring means 12 penetrate the positive-fitting elements 11 of the actuator 3 and are supported axially on the counterpart elements 15, 16.

It can be seen that the spring means 12 are guided during their translational adjustment movement into the securing position by means of a corresponding configuration of the counterpart elements 15, 16. At the same time, the actuator 3 is also axially guided in its translational installation movement along the adjustment axis 5, as soon as the positive-fitting means interact, already before the installation position according to FIG. 4 is reached.

Figure 5:
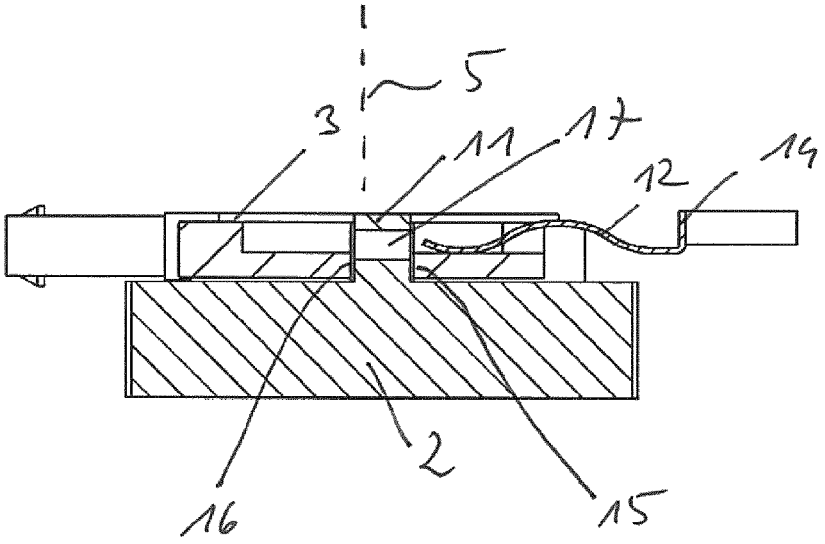
FIGS. 5 and 6: show a further exemplary embodiment of a camshaft adjustment device in different installation states.
Figure 6:
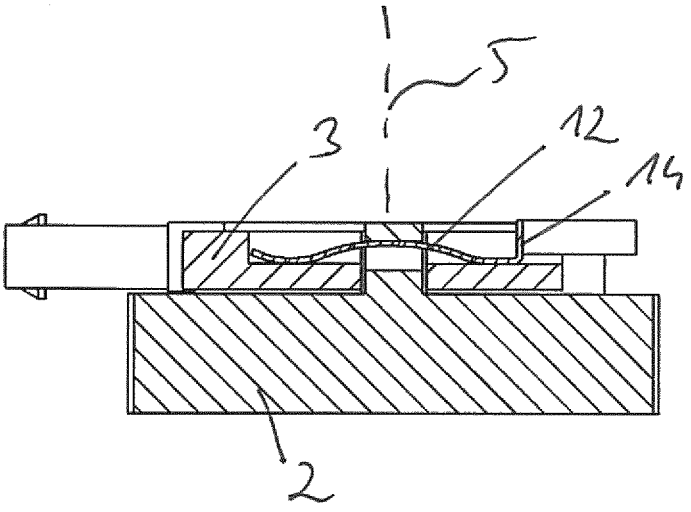

A sectional view of an installation situation is shown in FIGS. 5 and 6. The actuator 3 and the engine element 2 can be seen. A positive-fitting element 11 protrudes from the engine element 2 parallel to the adjustment axis 5 in the direction of the actuator 3 and is surrounded by counterpart element sections 15, 16 of the actuator 3. The positive-fitting element 11 has an opening 17 extending perpendicularly to the longitudinal extent of the adjustment axis 5, which is penetrated by the spring means 12 in the securing position of the same shown in FIG. 6. It can be seen that the spring means 12 in the installation position load the actuator 3 with spring force onto the engine element 2 axially with respect to the adjustment axis 5.

Figure 7:
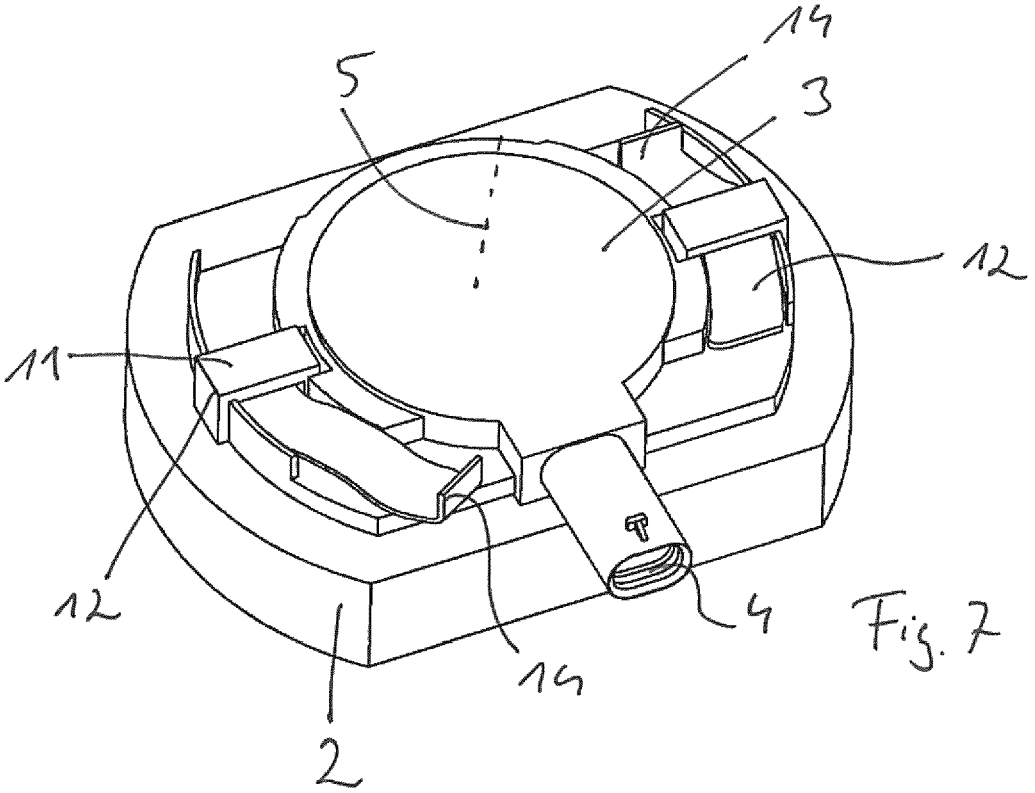
FIG. 7: shows an exemplary embodiment of a camshaft adjustment device with rotationally fastenable spring means.

In the exemplary embodiment according to FIG. 7, the spring means 12 are likewise designed in a strip-shaped manner, but the same are forced into a rotational movement when the same are transitioned into the securing position, as illustrated on the right in the drawing plane. In the securing position, the spring means 12 here by way of example penetrate a positive-fitting element 11 of the engine element 2 in each case.

Figure 8:
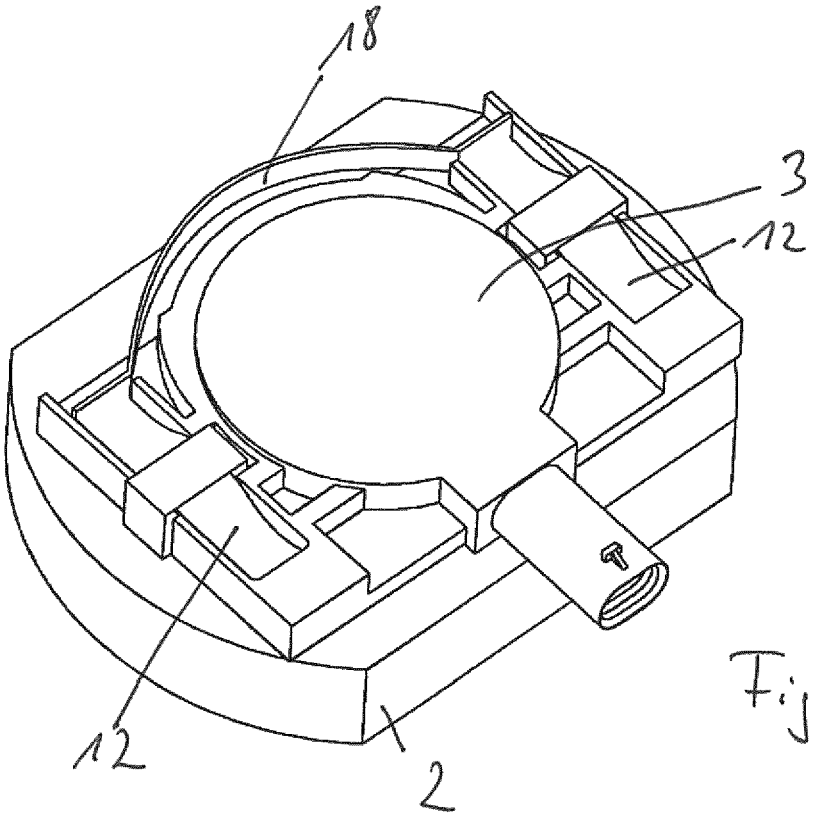
FIG. 8: shows an exemplary embodiment of a camshaft adjustment device with two spring strips constructed in one piece by means of a connecting piece, wherein the connection is of arcuate design.

In the exemplary embodiment according to FIG. 8, the spring means 12 comprise two strip-shaped spring sections, which are connected to one another via a connecting section 18, which is constructed in a bent manner in the exemplary embodiment shown, in order to thus pass round the actuator 3.

In the actual exemplary embodiment, the connecting section 13 is constructed in one piece with the spring sections, wherein the spring means 12 are preferably a stamped bent part. Due to the one-piece design or due to the mutual connection of two spring strips or spring sections, the entire spring means 12 can be transitioned into the securing position shown in FIG. 8 in a common fixing movement.

Figure 9:
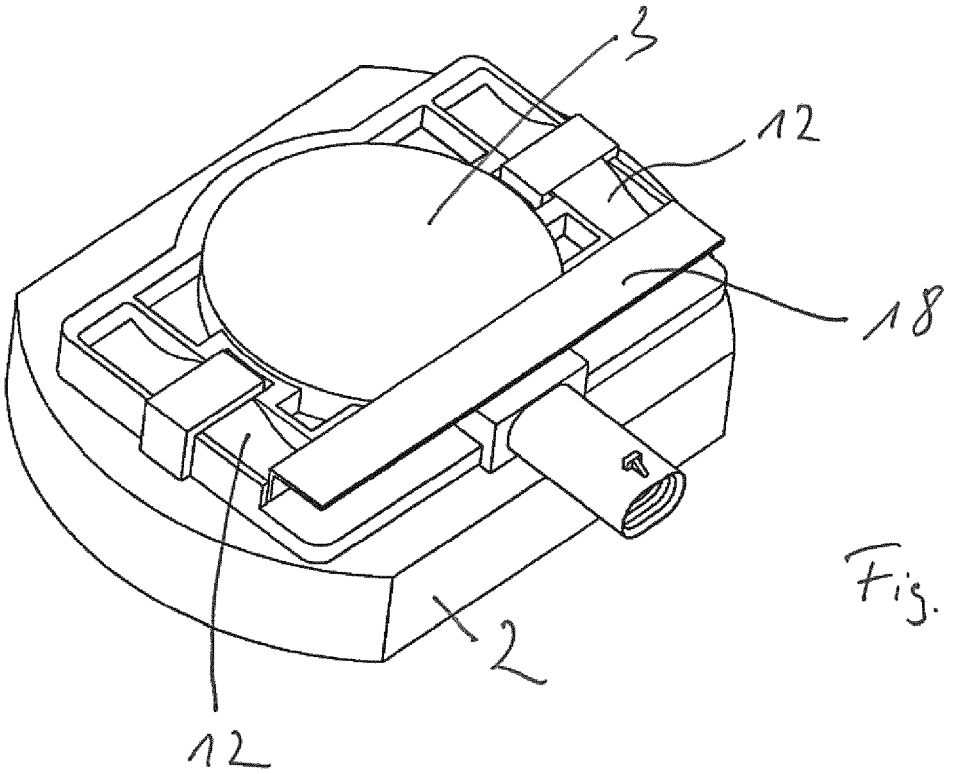
FIG. 9: shows a further alternative exemplary embodiment of a camshaft adjustment device with spring strips connected in a straight line.

In the exemplary embodiment according to FIG. 9, two spring sections that are constructed in one piece or connected to one another are again provided, wherein here however, the connecting section 18 is designed to be straight in the manner of an angled handle.

Figure 10:
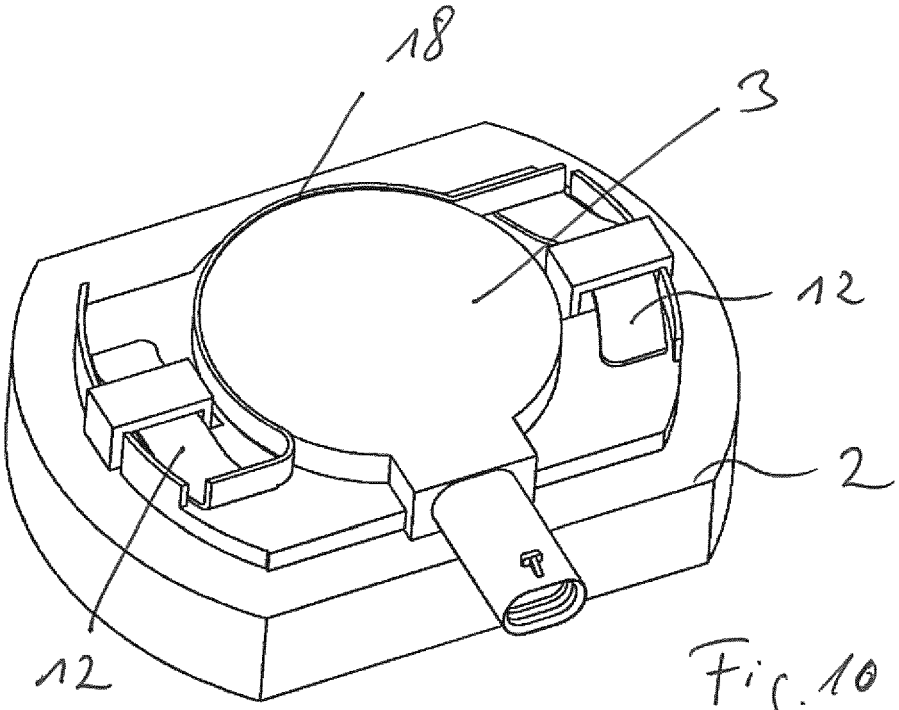
FIG. 10: shows a further alternative exemplary embodiment of a camshaft adjustment device with spring strips that are constructed in one piece and can be rotationally transitioned into a securing position.

In the exemplary embodiment according to FIG. 10, the spring means 12 comprise two rotationally adjustable spring sections, which are connected to one another by means of a bent connecting section 18, in order to thus be able to realise the rotational fixing movement of both spring sections in a common movement.

Figure 11:
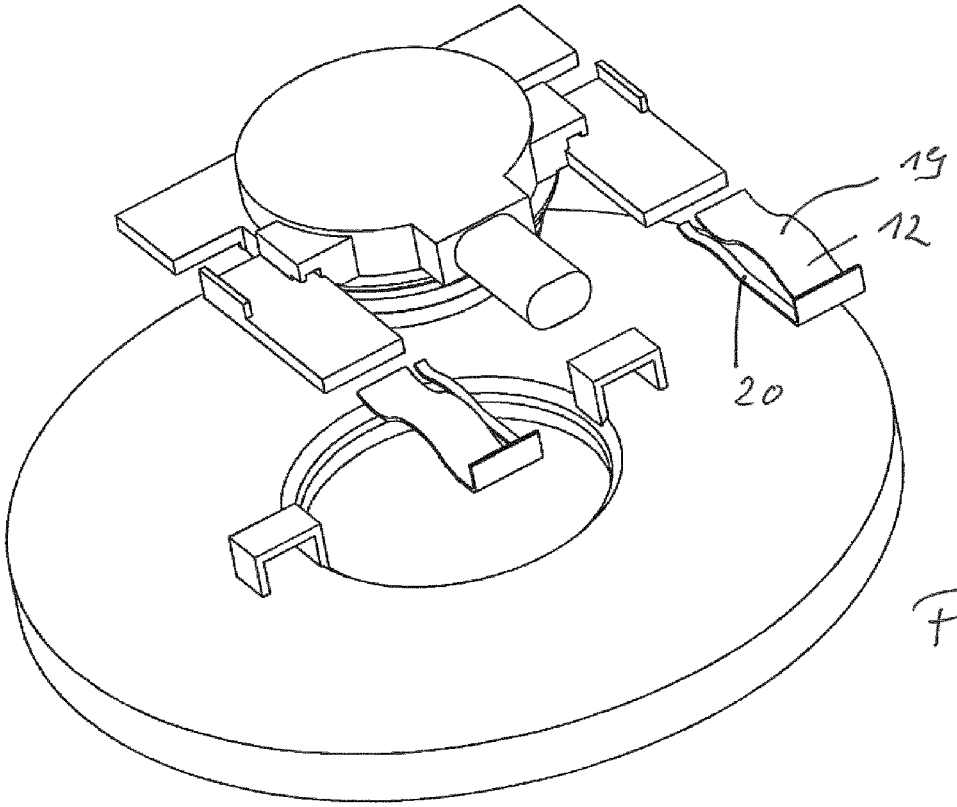
FIGS. 11 to 13: shows a further exemplary embodiment of a camshaft adjustment device with pre-installed spring means in different installation positions, wherein the spring means in each case have a main and an auxiliary spring section.
Figure 12:
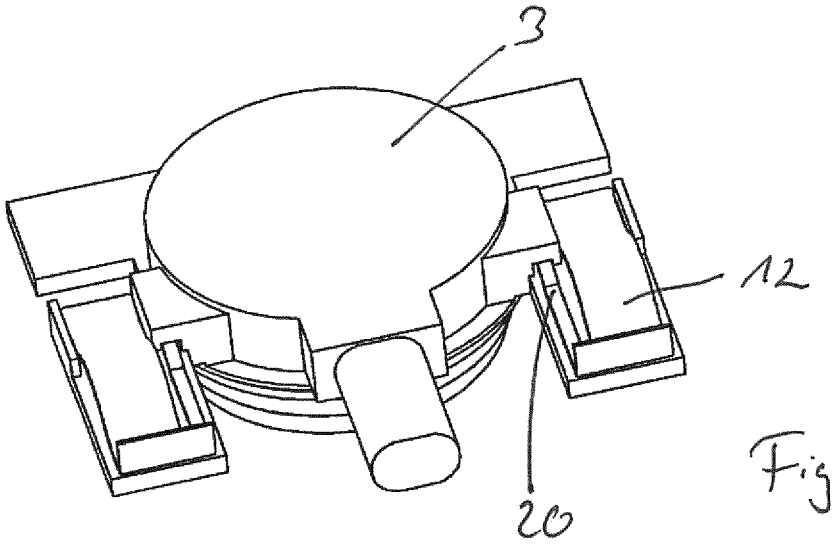
Figure 13:
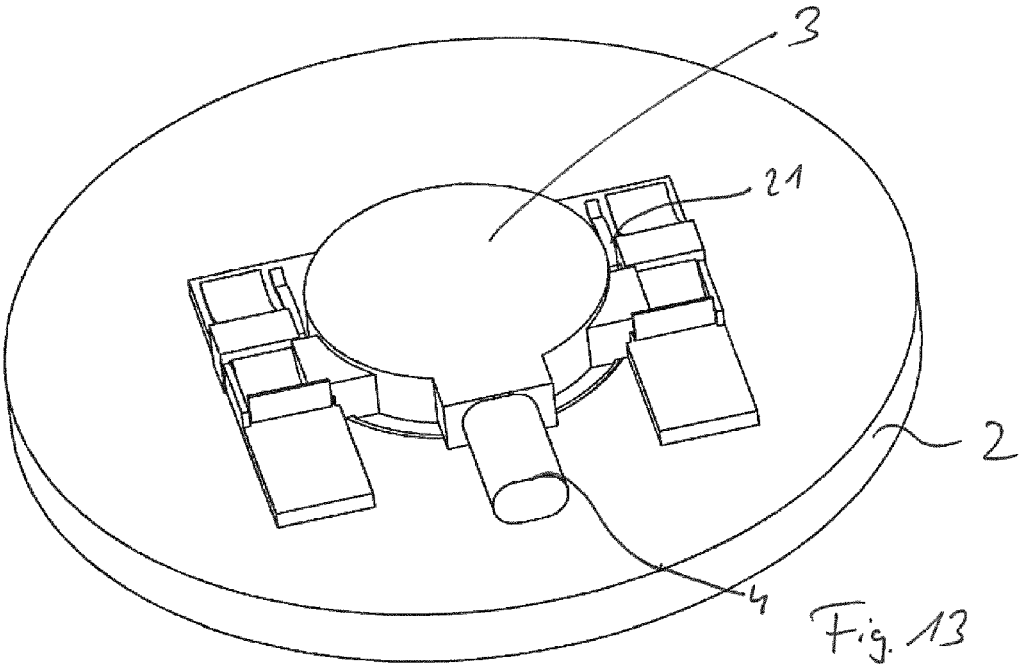

In the exemplary embodiment according to FIGS. 11 to 13, the spring means 12 comprise a main spring section 19 and an auxiliary spring section 20 running parallel thereto by way of example. The main spring section 19 has, as can be seen from FIG. 13, the task of tensioning the actuator 3 against the engine element 2 in the securing position shown, whilst the auxiliary spring section 20, as can be seen from FIG. 12, secures the spring means 12 in a pre-installation position on the actuator 3 in a tensioning manner. To this end, the auxiliary spring section 20 engages into a corresponding through opening of the actuator 3.

In the installation securing position shown in FIG. 13, a spring clip 21 or a spring elevation 21 of the auxiliary spring section 20 is pushed completely through the previously mentioned recess and therefore has no or hardly any spring action, whilst the main spring section 19 loads the actuator 3 with full spring force using its spring action and at the same time secures the actuator 3 on the engine element 2 against translational removal counter to the translational installation direction.

It can additionally be seen from FIGS. 11 to 13 that the auxiliary spring section 20 is configured to be substantially more filigree, narrower in the exemplary embodiment, than the main spring section 19. Furthermore, the spring elevations 21 are arranged in an offset manner in the direction of the longitudinal extent of the spring means 12.

Figure 14:
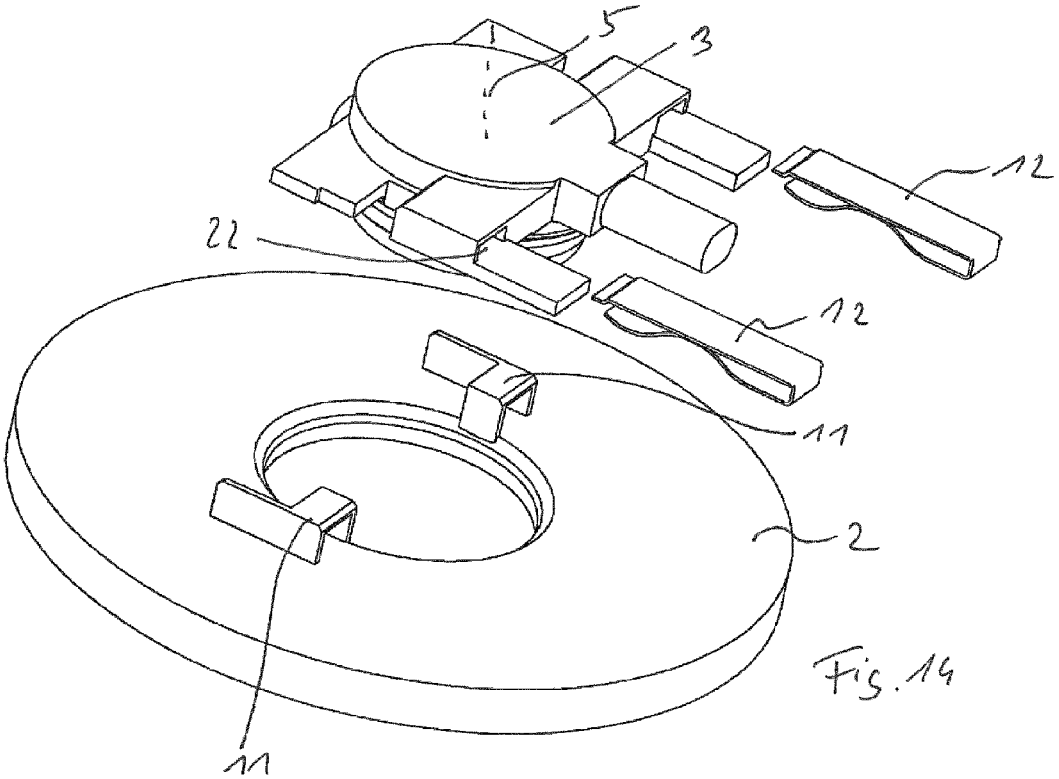
FIGS. 14 to 16: show a further alternative exemplary embodiment of a camshaft adjustment device with clip-like spring means.
Figure 15:
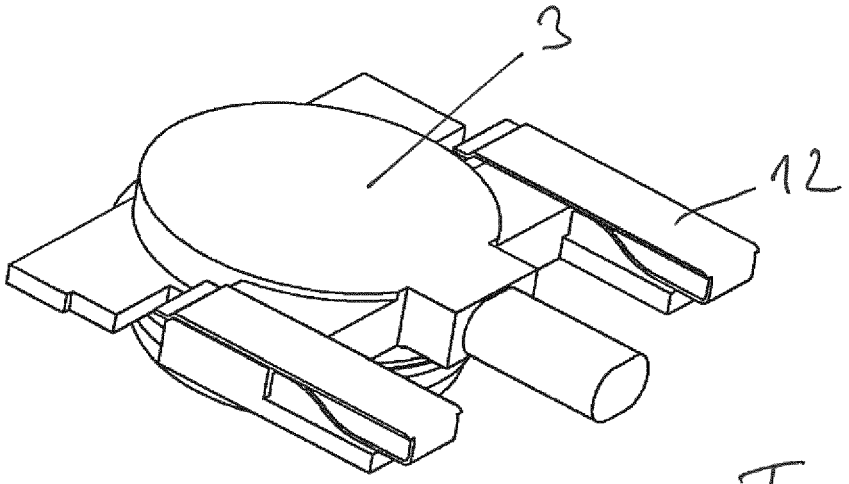
Figure 16:
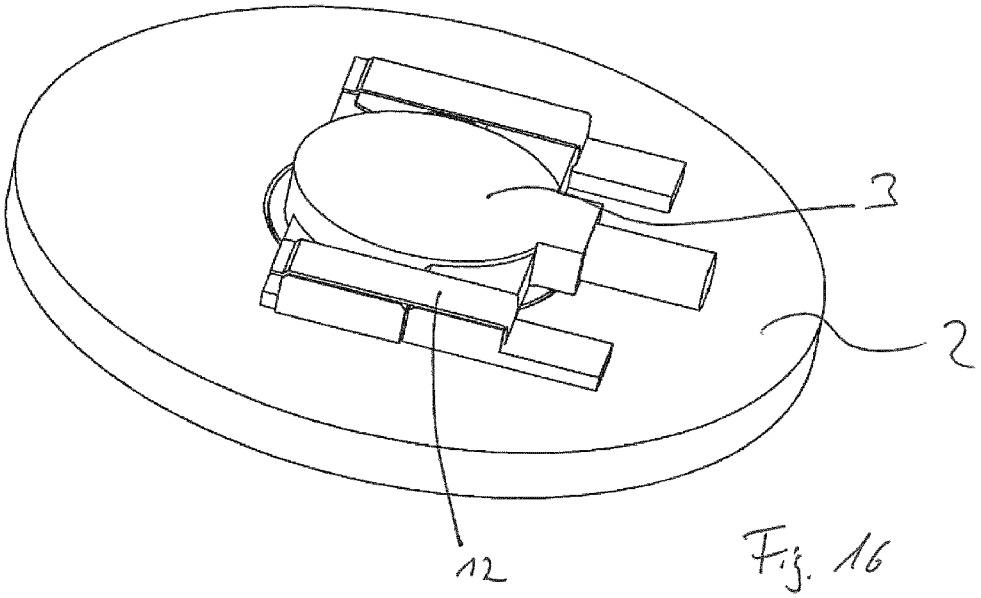

In the exemplary embodiment according to FIGS. 14 to 16, the spring means 12 are constructed as spring clips with two at least virtually parallel longitudinal sections. The spring means 12 can be held in a pre-installation position by clamping on the actuator 3, as is shown in FIG. 15. To this end, the spring means engage into an opening 22 in the actuator 3. After the transition of the actuator 3 into the installation position, the spring means 12 can be transitioned into the securing position shown in FIG. 16 wherein by way of example, they here in this securing position penetrate positive-fitting elements 11 of the engine element 2 in the direction of the longitudinal extent thereof and thus block the actuator 3 against translational removal. It can be seen in FIG. 14 that guide sections are formed onto the positive-fitting elements 11, in order to guide the clip-shaped spring means 12 during their translational fixing movement.

Figure 17:
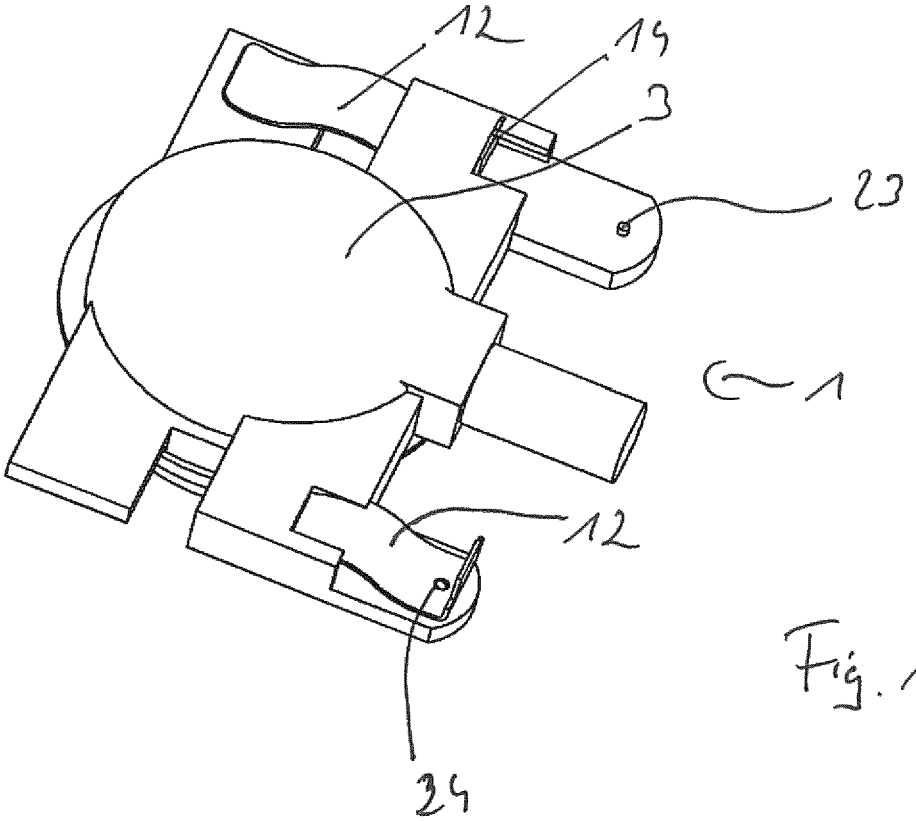
FIG. 17: shows a further exemplary embodiment of a camshaft adjustment device, in which the spring means can be latched in a pre-installation position on the actuator.

An embodiment of a camshaft adjustment device 1 and an actuator 3 of the same, respectively, are shown in FIG. 17, in which embodiment the exemplary strip-shaped spring means 12 here, as can be seen at the bottom in the drawing plane, are secured on the actuator 3 in a positive-fitting manner in a pre-installation position, specifically in that an elevation 23 of the actuator 3, which is located on a guide or support surface for the spring means 12, engages into an opening 24 in the spring means 12.

Figure 18:
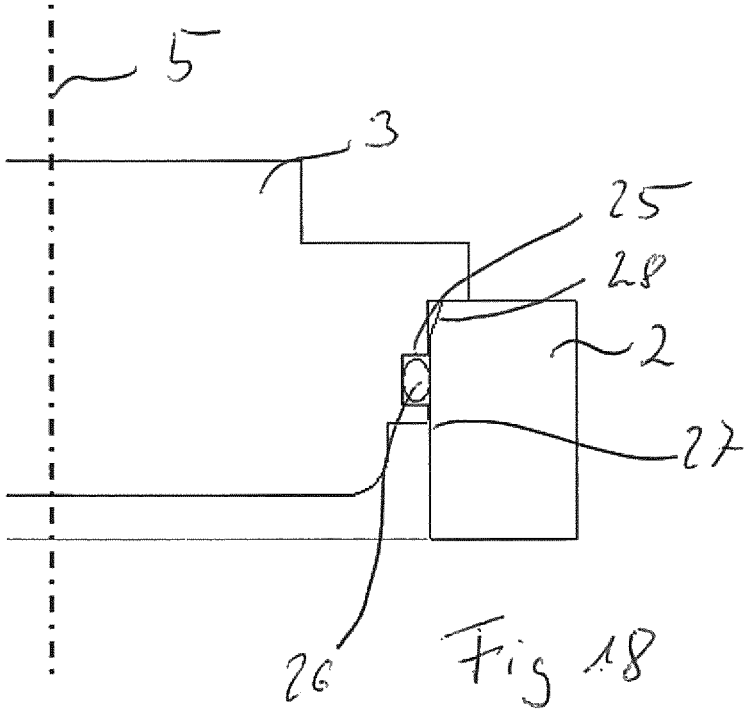
FIG. 18: shows a schematic illustration of an assembly situation of an actuator of a camshaft adjustment device, wherein the actuator is actually supported in the radial direction on the internal circumference of an accommodation opening (recess) for the actuator in the engine element by means of a sealing ring on the engine element constructed as a conventional o-ring seal.

A generic assembly situation of an actuator of a camshaft adjustment device according to the invention is shown by way of example in FIG. 18, as can be realised in all of the previously described exemplary embodiments but is not shown in detail there for reasons of clarity. It can be seen that a sealing ring 26 constructed as a conventional o-ring seal is accommodated in a lateral circumferential groove 25 on the circumferential side on the actuator 3, which sealing ring is loaded by force in the radial direction in the assembly situation and in the process is supported radially internally on the base of the groove of the circumferential groove and on the internal circumference 27 of an accommodation opening in the engine element 2 for the actuator 3. As the installation of the actuator 3 takes place in a pure plugging direction, the sealing ring 26 is not loaded with force in the circumferential direction around the adjustment axis 5 of the actuator armature during installation nor during de-installation. During installation, the sealing ring 26 is moved along a chamfer or lead-in chamfer 28 of the accommodation opening on the engine element 2, as a result of which a radial force component is generated on the sealing ring 26.

The invention claimed is:

1. A camshaft adjustment device comprising an electromagnetic actuator (3) having an armature that is adjustable axially along an adjustment axis (5) for actuating a hydraulic valve for camshaft adjustment, and fastening means for fastening the actuator (3) on an engine element (2), wherein the fastening means comprise spring means (12), which tension the actuator (3) against the engine element (2) in a securing position (13), wherein the fastening means have positive-fitting means (8) as an anti-twist device for preventing a twisting movement of the actuator (3) in an installation position (7) relatively to the engine element (2), which are constructed and arranged in such a manner that the actuator (3) is movable to the engine element (2) by means of a pure translational installation movement and wherein the spring means (12) in the securing position (13) bar a de-installation path for a pure translational de-installation movement of the actuator (3) opposite to the installation movement in such a manner that the actuator (3) cannot be de-installed oppositely to a direction of the pure translational installation movement.

2. The camshaft adjustment device according to claim 1, wherein the actuator (3) is axially guided during translational installation movement.

3. The camshaft adjustment device according to claim 1, wherein the positive-fitting means (8) have at least one positive-fitting element (11) extending parallel to the adjustment axis (5) on the actuator (3), which is accommodated in the installation position (7) in each case by two counterpart elements (15, 16) or counterpart element sections of the engine element (2) that are spaced around the adjustment axis (5) in a circumferential direction and extend parallel to the adjustment axis (5), which counterpart elements or counterpart element sections delimit an installation opening extending parallel to the adjustment axis (5) and/or wherein the positive-fitting means (8) have at least one positive-fitting element (11) extending parallel to the adjustment axis (5) on the engine element (2), which is accommodated in the installation position (7) in each case by two counterpart elements (15, 16) or counterpart element sections of the actuator (3) that are spaced around the adjustment axis (5) in a circumferential direction and extend parallel to the adjustment axis (5), which counterpart elements or counterpart element sections delimit an installation opening extending parallel to the adjustment axis (5).

4. The camshaft adjustment device according to claim 3, wherein the spring means (12) in the securing position (13) either:

penetrate the positive-fitting means (8) and/or the counterpart elements (15, 16) or counterpart element sections, or at least engage into an accommodation opening of the positive-fitting element (11) or at least a counterpart element (15, 16) or at least one counterpart element section.

5. The camshaft adjustment device according to claim 1, wherein the spring means (12) is transitionable into the securing position (13) in a translational or rotational fixing movement.

6. The camshaft adjustment device according to claim 5, wherein the translational or rotational fixing movement is executable in a fixing plane extending at an angle to the direction of the pure translational installation movement.

7. The camshaft adjustment device according to claim 1, wherein the spring means (12) comprise a spring strip or a spring clip, which is resilient in a direction perpendicular to a longitudinal extent of the spring strip or spring clip and/or wherein two spring strips or spring clips of the spring means (12) are connected, by means of a connecting section (12), enabling transition of the spring strips or spring clips into the securing position (13) in a common fixing movement.

8. The camshaft adjustment device according to claim 1, wherein, in the installation position (7) of the actuator (3), the spring means (12) is moveable out of a pre-installation position into the securing position (13).

9. The camshaft adjustment device according to claim 1, wherein the spring means (12) have a main spring section (19) for tensioning the actuator (3) against the engine element (2) and an auxiliary spring section (20) for holding the spring means (12) in a pre-installation position on the actuator (3), and wherein the auxiliary spring section (20) is constructed and/or arranged in such a manner that, in the securing position (13), the spring means (12) does not tension the actuator (3) against the engine element (2) or tension the actuator (3) against the engine element (2) with a smaller spring force than the main spring section (19).

10. The camshaft adjustment device according to claim 1, wherein the spring means (12) have a stop (14), for delimiting the fixing movement thereof and/or a gripping surface for simplified installation and de-installation.

11. The camshaft adjustment device according to claim 1, wherein the spring means (12) have an opening or depression for latching interaction with an elevation (23) of the actuator (3) or the engine element (2).

12. The camshaft adjustment device according to claim 1, wherein a sealing ring (26) is accommodated on the actuator (3), which sealing ring is loaded by force exclusively in axial and radial directions.

13. An internal combustion engine having a camshaft adjustment device (1) according to claim 1.

14. An installation method for a camshaft adjustment device (1) comprising an electromagnetic actuator (3) having an armature that is adjustable axially along an adjustment axis (5) for actuating a hydraulic valve for camshaft adjustment, and fastening means for fastening the actuator (3) on an engine element (2), wherein the fastening means comprise spring means (12), which tension the actuator (3) against the engine element (2) in a securing position (13), wherein the fastening means have positive-fitting means (8) as an anti-twist device for preventing a twisting movement of the actuator (3) in an installation position (7) relatively to the engine element (2), which are constructed and arranged in such a manner that the actuator (3) is movable to the engine element (2) by means of a pure translational installation movement and wherein the spring means (12) in the securing position (13) bar a de-installation path for a pure translational de-installation movement of the actuator (3) opposite to the installation movement in such a manner that the actuator (3) cannot be de-installed oppositely to a direction of the pure translational installation movement, the method comprising the steps of:

transitioning the actuator (3) into the installation position (7) on the engine element (2) in the translational installation movement in which installation position the actuator (3) is secured by means of the positive-fitting means (8) against twisting relatively to the engine element (2), and transitioning the spring means (12) into the securing position (13), in which the spring means (12) tension the actuator (3) against the engine element (2) and at the same time bar the de-installation path opposite to a translational installation path of the actuator (3) along the adjustment axis (5) of the armature and secure the actuator (3) on the engine element (2) against the translational de-installation movement opposite to the translational installation movement of the actuator (3).

15. The installation method according to claim 14, further comprising transitioning the spring means (12) from a pre-installation position on the actuator (3) into the securing position (13) whereby the actuator (3) is tensioned and secured.

16. The installation method according to claim 14, further comprising the step of loading a sealing ring (26), provided on the actuator (3), with force during installation exclusively in an axial direction and/or in a radial direction, but not in a circumferential direction.

* * * * *